US005419382A

United States Patent [19]

Thompson

[11] Patent Number: 5,419,382

[45] Date of Patent: May 30, 1995

[54] VENEER FLATTENING APPARATUS AND METHOD

[75] Inventor: Kenneth O. Thompson, Oneida, Tenn.

[73] Assignee: Hartco Flooring Company, Oneida, Tenn.

[21] Appl. No.: 154,175

[22] Filed: Nov. 18, 1993

[51] Int. Cl.[6] ..... B25H 1/00; B27M 1/02

[52] U.S. Cl. ..... 144/362; 144/2 R; 144/255; 144/329; 100/155 R; 100/176

[58] Field of Search ..... 72/65, 107, 173; 100/155 R, 176, 160; 144/2 R, 255, 332, 329, 362

[56] References Cited

U.S. PATENT DOCUMENTS

| | | | |
|---|---|---|---|
| 4,362,197 | 12/1982 | Wick et al. | 144/364 |
| 4,503,892 | 3/1985 | Gonner | 144/3 P |
| 4,516,614 | 5/1985 | Grimhall et al. | 144/364 |
| 4,977,940 | 12/1990 | Gönner et al. | 144/255 |
| 5,002,106 | 3/1991 | Binder | 144/364 |
| 5,088,533 | 2/1992 | Binder | 144/364 |
| 5,255,725 | 10/1993 | Gonner | 144/255 |

OTHER PUBLICATIONS

"Face Veneer Manufacturer Shapes F-l-e-x-ible Market", *Panel World*, pp. 14–17 (Jul. 1992).

*Primary Examiner*—W. Donald Bray
*Attorney, Agent, or Firm*—Fred Hook

[57] ABSTRACT

An apparatus and method flatten a twisted veneer directly from the device which cuts the veneer from a board. In a particular implementation, the veneer is counter-twisted through a curved channel formed between two roller assemblies whose rollers are discretely disposed through a predetermined sector.

21 Claims, 3 Drawing Sheets

VENEER FLATTENING APPARATUS AND METHOD

BACKGROUND OF THE INVENTION

This invention relates to flattening twisted veneers as soon as they come from a cutting device.

Veneers as used in this specification are thin sheets of wood used to make plywood and other composite wood products. An example of a specific end use is in wood flooring.

Different techniques for cutting veneers from boards are known. U.S. Pat. No. 5,002,106 to Binder discloses sawing with a bandsaw and slicing with a knife, for example. Various techniques applicable to at least slicing are referred to in the background portion of U.S. Pat. No. 4,516,614 to Grimhall et al. For example, the Grimhall et al. patent refers to a slicing technique in which the board is moved longitudinally across an inclined knife so that the knife slices a veneer of desired thickness from the board. Typically the knife lies obliquely in a horizontal table across which the board is moved. See also U.S. Pat. No. 4,362,197 to Wick et al.

The Wick et al. patent refers to a problem, namely, curling of the veneer, that typically and persistently occurs at least when a veneer is sliced from a board using the aforementioned oblique or inclined knife slicing technique. The process disclosed in the Wick et al. patent includes a step of "soaking the face of the lumber to be sliced in a water bath long enough to eliminate excessive curling of the veneer upon slicing . . . ," (column 1, lines 64–66). Elsewhere the Wick et al. patent states that the quality of the veneer is a function of the type of lumber, the bath temperature, and the residence time in the bath, whereby these factors preferably interrelate such that curling "is only a minor problem" (column 2, lines 18–32).

In the aforementioned '106 patent to Binder (and his related U.S. Pat. No. 5,088,533), Binder did not consider the curling, or warping, problem solved. Binder says, "Furthermore, the quality of the wood sheets thus produced leaves much to be desired, especially since the individual wood sheets leave the cutting device in a greatly warped state, which derives from the fact that the wood sheets cut off from the cut wood plank are carried away obliquely to their original direction of transportation. In the known cutting device, consequently, the problem is posed, which has not been solved to date, of restoring such warped wood sheets into their non-warped, level or flat state at a justifiable expense." (column 2, lines 3–13). Binder's proposed solution is to press the veneers between opposed carpets of wire mesh during drying in a drying apparatus (column 2, lines 33–37; column 3, lines 56–66; and column 6, lines 21–25).

Although the flattening process referred to in the Binder patents may be beneficial, there remains at least the shortcoming of handling difficulties that can arise in transporting the nonflat veneer from the cutting device to the drying apparatus, assuming a drying apparatus is used. That is, when a curled veneer exits a cutting device onto a conveyor as has been the typical practice in the present inventor's experience, the curled veneer generally tends to rock and turn and otherwise shift on the conveyor. This makes handling difficult, and it also causes veneers to be damaged. Such damage causes waste, increases cost and reduces yield (the amount of usable wood per board). This is detrimental both environmentally and financially. Thus, there is the need for an apparatus and method which can immediately flatten veneers as they come directly from the cutting device.

SUMMARY OF THE INVENTION

The present invention overcomes the above-noted and other shortcomings of the prior art and meets the aforementioned needs by providing a novel and improved apparatus and method for flattening veneers. The present invention provides improved handling of the veneers as soon as they are cut by a cutting device. The present invention also obtains improved yield. Thus, the present invention is both environmentally and financially beneficial.

The apparatus for flattening a veneer comprises: mechanical means for mechanically applying a flattening force to a veneer directly from a cutting device that cuts the veneer from a board; and support means for supporting the mechanical means adjacent the cutting device. In the preferred embodiment, the mechanical means includes: a first roller assembly connected to the support means; and a second roller assembly connected to the support means adjacent the first roller assembly. The first and second roller assemblies include respective pluralities of rollers disposed so that a curved channel is defined between the rollers. The mechanical means transports the veneer through the curved channel and the rollers apply the flattening force to the veneer as the veneer is transported through the curved channel.

The method of flattening a veneer comprises: receiving a veneer directly from a cutting device; and twisting the received veneer through a predetermined sector counter to a predetermined orientation of twist normally obtained by the veneer as the veneer is cut.

Therefore, from the foregoing, it is a general object of the present invention to provide a novel and improved apparatus and method for flattening veneers. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 5 is another side view of the support means and the mechanical means of the preferred embodiment of the flattening apparatus.

FIG. 6 is an outlet end view of the support means and the mechanical means of the preferred embodiment of the flattening apparatus.

DETAILED DESCRIPTION OF PREFERRED EMBODIMENTS

Figure 1:
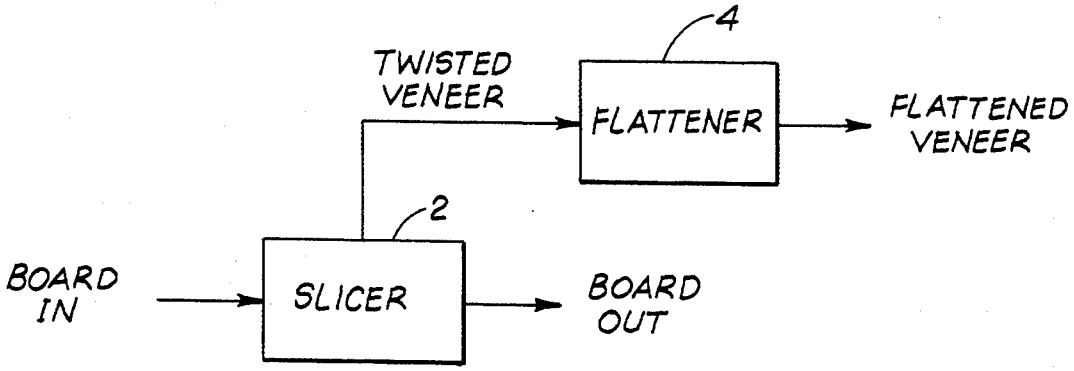
FIG. 1 is a block diagram of a cutting device and a flattening apparatus of the present invention.

Referring to FIG. 1, a board is fed into a cutting device 2 so that the cutting device cuts a veneer from the board in known manner. The remainder of the board exits the cutting device 2, and the veneer is transported directly from the cutting device 2 to a flattening apparatus, or flattener, 4 of the present invention. "Directly" as used in this context refers specifically to the immediate veneer discharge path from the cutting device so that the veneer proceeds first to the flattening apparatus 4 before any other transporting or processing of the veneer.

In the preferred embodiment of the present invention, the cutting device 2 is specifically a conventional slicer as labeled in FIG. 1. Such a conventional slicer has a flat slicing table obliquely across which a cutting member, or knife, is disposed in known manner. Suitable slicers are manufactured by Amitech Corporation (e.g. model VT25I slicer), Marunaka Tekkosho, Inc. (e.g., model SL-25A slicer) and Takikawa Iron Works Company, Ltd. (e.g. model VT25I slicer), for example. It is noted, however, that the present invention is not limited to any particular type of cutting device, but rather is useful with whatever cutting device or process produces a veneer that can be flattened in accordance with the present invention.

The type of board to be used in the cutting device 2 can be of any suitable type known in the art. The preferred type, however, is a board having a moisture content of at least about sixty percent (60%). More preferably, the board is "green lumber" having a moisture content of at least about eighty percent (80%). A board of this type typically provides a veneer which is twisted along its length when it exits the cutting device 2. As mentioned above, such a twisted configuration is unavoidable and undesirable. This is to be corrected by the flattening apparatus 4 directly from the veneer output of the cutting device 2. For a particular orientation of cutting member, the twisted configuration will have the same orientation for each veneer slice.

The flattening apparatus 4 includes guide means 6 which will be described with reference to FIG. 2. The guide means 6, which is disposed adjacent the cutting device 2, guides the veneer directly from the cutting device 2 into a mechanical means of the flattening apparatus 4 to be described hereinbelow.

Figure 2:
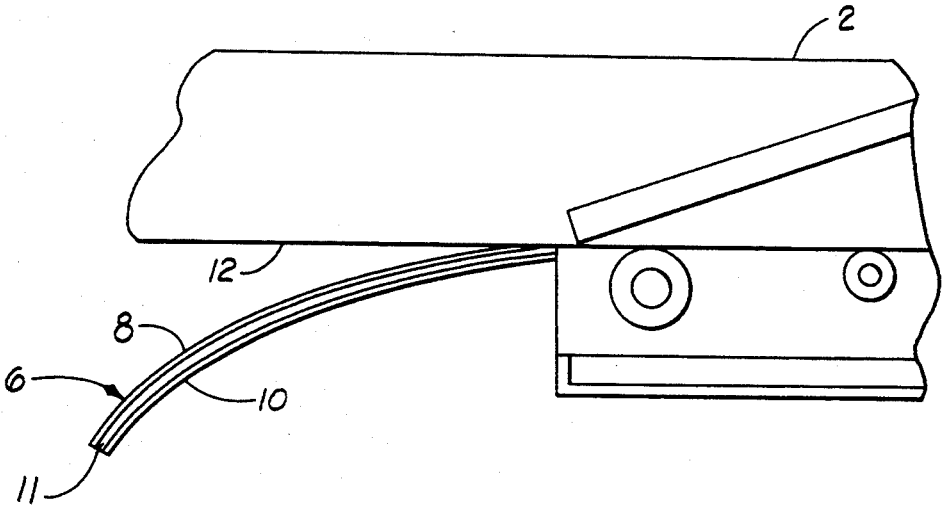
FIG. 2 is a plan view showing part of a guide means of the preferred embodiment of the flattening apparatus, which guide means is connected to the cutting device.

Although not fully visible in FIG. 2, the guide means 6 of the preferred embodiment has an inner set of two stainless steel plates and an outer set of two stainless steel plates bolted along their bottom edges to an aluminum lower member spacing the two sets of plates so that a desired vertical slot (e.g., 0.625-inch wide for a 0.140-inch veneer) is defined between the inner and outer sets of plates and above the aluminum strip. In a particular implementation, the overall length of the guide means 6 can be over five feet; however, the general design criterion is to have the guide means 6 of sufficient length that it guides the leading edge of the veneer into engagement with the mechanical means while at least a portion (e.g., one to two inches) of the rear of the veneer remains attached to the board which is then still passing across the cutting member of the cutting device 2. This is preferred so that the veneer is always held at least at one end. As the board completes its pass across the cutting member, the leading end of the then fully severed veneer will already be engaged by and drawn into the mechanical means of the flattening apparatus 4, and the trailing end of the veneer will be supported by the guide means 6. In a particular implementation, outermost plates 8, 10 visible in FIG. 2 (as is a portion of lower member 11) are approximately thirty-two inches long and approximately fourteen inches high, and they curve approximately eight inches from a vertical side 12 of the cutting device 2 to which the guide means 6 is connected. In the preferred embodiment, the overall guide means 6 is connected to the cutting device 2 by sitting on the frame of the cutting device 2 near where the veneer comes off the cutting member of the cutting device, and the guide means 6 is bolted to the mechanical means which receives the veneer from the guide means 6. The particular angular orientation of the guide means 6 relative to a specific cutting device 2 can be adjusted as needed to accommodate a desired angle at which the veneer is to be transported into the mechanical means of the flattening apparatus.

Figure 3:
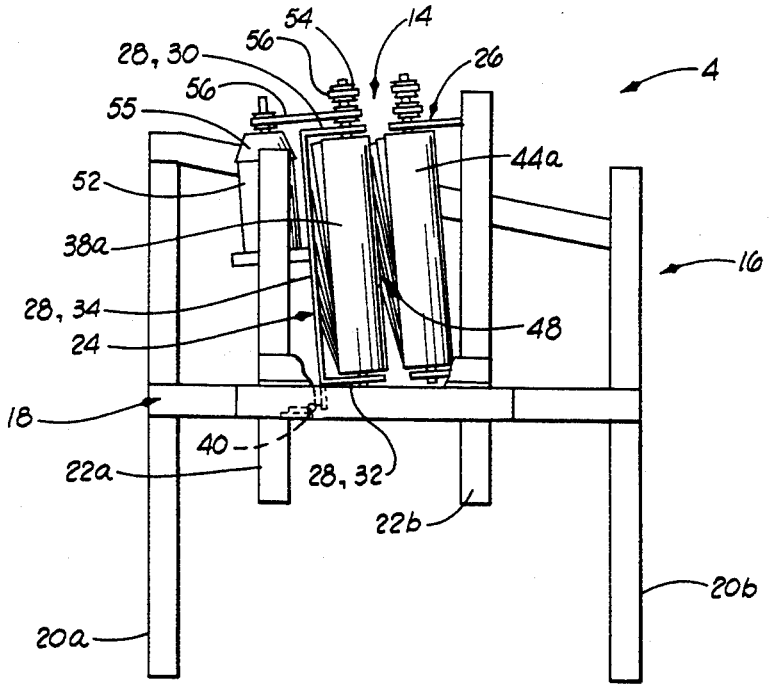
FIG. 3 is an inlet end view of a support means and a mechanical means of the preferred embodiment of the flattening apparatus.

The mechanical means of the flattening apparatus 4 is generally identified in FIGS. 3–6 by the reference numeral 14 (for purposes of simplicity, the elements described below with reference to FIGS. 3–6 or otherwise shown in one or more of FIGS. 3–6 are not necessarily shown in each of the drawings; for example, FIG. 3 shows primarily the inlet structure with some background elements of that view omitted and FIG. 6 shows primarily the outlet structure with some of the background elements of that view omitted). The mechanical means 14 mechanically applies a flattening force to the veneer directly from the cutting device 2. The mechanical means 14 is mounted on support means 16 for supporting the mechanical means adjacent the cutting device 2.

The primary purpose of the support means 16 is to provide a base to which the mechanical means 14 is connected. Any suitable such base can be used. In the preferred embodiment shown in FIGS. 3–6, the support means 16 has a trapezoidal base frame 18. In a particular implementation, the trapezoidal shape has the appearance of a truncated triangle with the wider end approximately twice as wide as the narrower end (in one particular implementation, for example, the wider end of the base frame 18 is approximately thirty-four inches wide and the narrower end of the base frame 18 is approximately sixteen inches wide).

Holding the base frame 18 off the floor are two pairs of legs 20, 22 . Legs **20*a*, 20*b* are longer than legs 22*a*, 22*b* so that the legs 22 can be placed on top of a base of the adjacent cutting device 2 and the legs 20 can be placed on the floor with the base frame 18 disposed approximately horizontally to the floor (but preferably slightly tilted, e.g., 5°–6°, downwardly from inlet end to outlet end to enhance the counter-twisting applied to the veneer). The support means 16** can be made of any suitable material. Specific examples are two-inch × two-inch × ¼-inch angle iron or two-inch square tubing.

The mechanical means 14 that is mounted on the support means 16 in the preferred embodiment includes two roller assemblies 24, 26. The roller assembly 24 includes a metal frame 28 which, in effect, begins as a rectangular shape but is twisted through a predetermined sector with one end of the frame substantially vertical and the opposite end of the frame substantially horizontal. In a particular implementation, the substantially vertical end is approximately 5° from vertical and the substantially horizontal end is approximately 80° from vertical. The direction of the twist is opposite the direction of twist in the veneers to be flattened. The frame 28 includes side plates 30, 32 and end plates 34 (FIG. 3), 36 (FIG. 6) welded to the side plates 30, 32.

Mounted between the side plates 30, 32 are rollers 38. Extending from each end of the main body of each roller 38 is a spindle suitably journaled relative to the side plate so that the rollers 38 can rotate. In two specific implementations, there are either fourteen or fifteen 3.5-inch outer diameter rollers 38 mounted along the frame 28 on four-inch centers. The main body of each such roller is approximately eighteen inches long. Each of these is disposed at a respective angle along the twist or curve of the frame 28. In traversing an approximately 75° sector (e.g., the sector between about 5° from vertical and about 80° from vertical referred to above), each roller 38 is angularly disposed approximately 5°–6° from the adjacent rollers. The overall length of such a specific roller assembly is less than approximately five feet.

The roller assembly frame 28 is connected to the support means 16 by a hinge 40 (FIG. 3) and a hinge 42 (FIG. 6). This allows the roller assembly 24 to be pivoted relative to the support means 16 and the roller assembly 26 under control of an air cylinder 43 (manual control can be implemented by affixing a handle to the roller assembly to be pivoted). A stop member (not shown) prevents the roller assembly 24 from pivoting downwardly more than a desired amount (e.g., four inches in a particular implementation). Alternatively, the frame 28 of the roller assembly 24 can be connected in a fixed position relative to the support means 16 and the roller assembly 26 can be pivoted relative thereto.

The construction of the roller assembly 24 and its mounting to the support means 16 can be such that the assembly or parts thereof (e.g., the rollers 38) are adjustable to provide for different settings, and thereby different operating conditions.

The roller assembly 26 is constructed the same as the roller assembly 24 except in the preferred embodiment the roller assembly 26 is fixed in position relative to the support means 16 when the roller assembly 24 is pivotally mounted to the support means 16; however, the roller assembly 26 can be the pivoted assembly (both roller assemblies can be pivoted or fixed; however, pivoting allows easy access to the space between the roller assemblies). The rollers of the roller assembly 26 are identified by the reference numeral 44.

The roller assemblies 24, 26 are disposed relative to each other so that a curved channel 46 (numbered in FIG. 5) is defined between the rollers. The channel 46 has a substantially vertical inlet opening 48 (FIG. 3) for receiving the veneer in a substantially vertical orientation, and it has an outlet opening 50 (FIG. 6) through which the veneer is output in a substantially horizontal orientation. In the preferred embodiments, the veneer is twisted through a predetermined sector of less than about 90° (e.g., the approximately 75° sector referred to above) as it traverses the channel 46.

In the preferred embodiment, associated with the air cylinder 43 in a known manner is a pressure regulator (not shown) which automatically adjusts the air cylinder 43 to try to maintain a predetermined pressure. This provides the flattening apparatus 4 with automatic control of the spacing between the rollers 38, 44 in response to the thickness of the veneer or veneers passing through the channel 46 at any one time. That is, if the veneer thickness is such that the roller assemblies 24, 26 need to be opened away from each other, the pressure regulator will respond and the piston of the air cylinder 43 will retract to lower the roller assembly 24. Conversely, if the channel 46 needs to be narrowed in response to a thinner veneer, the pressure regulator will respond so that the piston of the air cylinder 43 extends to move the roller assembly 24 closer to the roller assembly 26. As mentioned above, mechanical stops can be used to limit the maximum spacing between the roller assemblies 24, 26. Likewise, mechanical stops can be used to limit the minimum spacing between the roller assemblies 24, 26.

Figure 4:
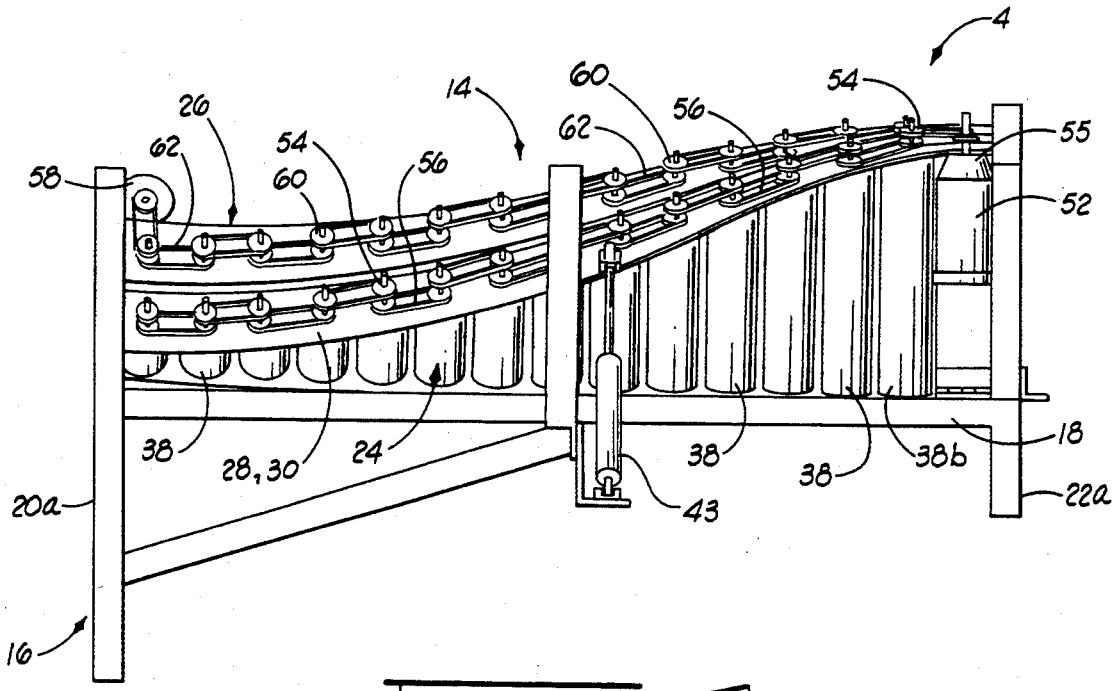
FIG. 4 is a side view of the support means and the mechanical means of the preferred embodiment of the flattening apparatus.
Figure 3:
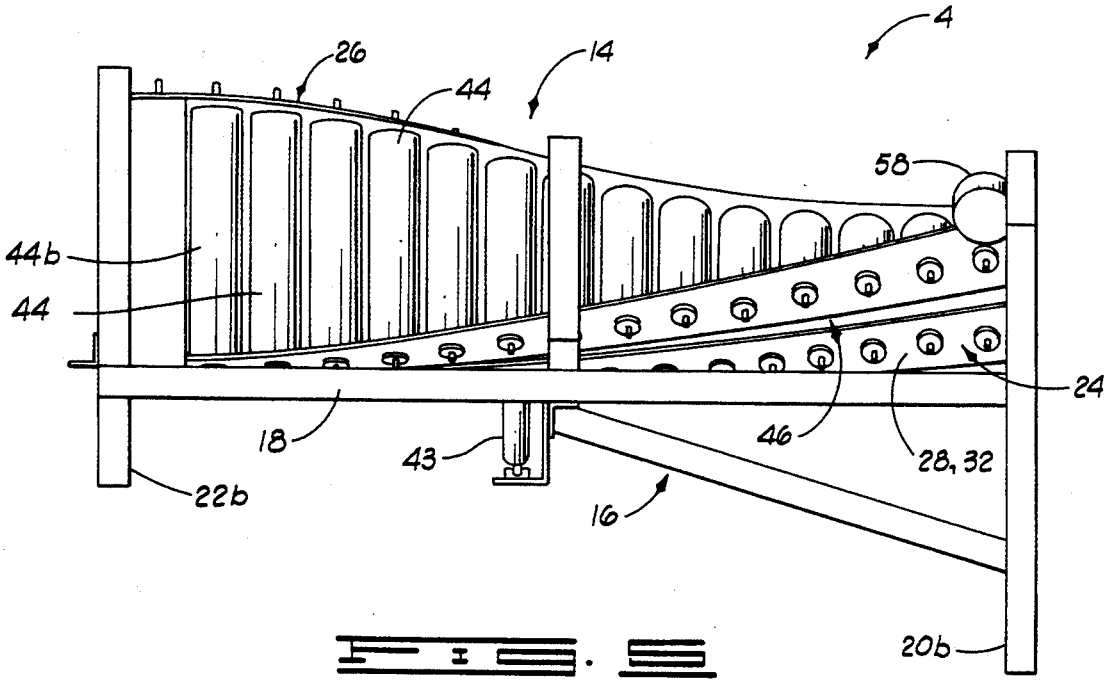
Figure 4:
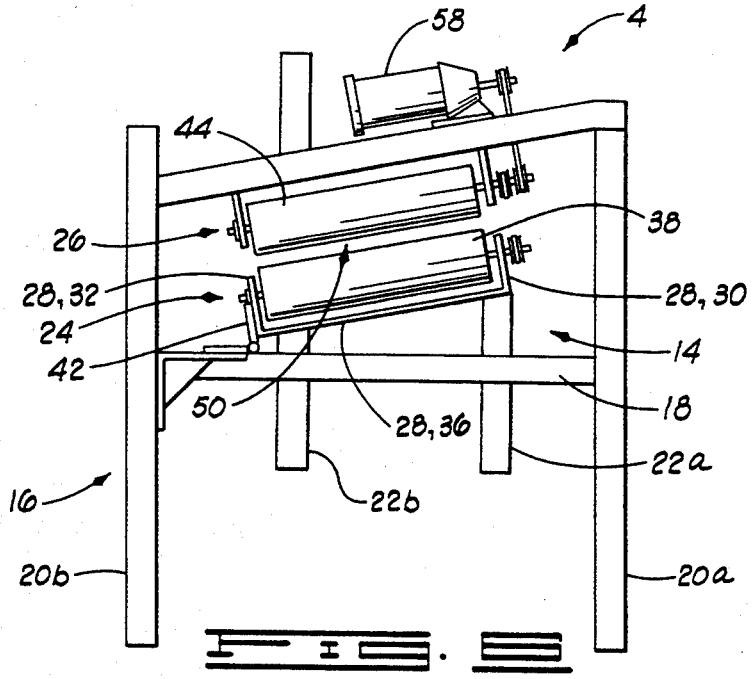

It is also to be noted that in the preferred embodiment the first two pairs of corresponding rollers 38, 44 are laterally aligned whereas the remaining pairs of corresponding rollers offset so that as a veneer traverses the channel, it substantially simultaneously passes each roller in the first two pairs but then sequentially passes a roller of one roller assembly, then a roller of the other roller assembly, then the next roller of the first assembly and then the next roller of the other assembly, etc. Referring to FIGS. 4 and 5, rollers **38*a*, 38*b* are laterally aligned, or are directly across from, the rollers 44*a*, 44*b*, respectively. The remainder of the rollers, which constitute a majority but less than all of the rollers, are offset from their counterparts in the opposite roller assembly. As the mechanical means 14 transports the veneer through the curved channel 46, these rollers 38, 44 collectively apply the flattening force which is specifically a twisting force counter to the predetermined twist that the veneer obtains as it is cut from the board in the cutting device 2 (i.e., sliced in the slicer in the preferred embodiment). The distance of the lateral spacing can be controlled as explained above; however, at least the first rollers 38*a*, 44*a*** are preferably initially close enough together to ensure that the leading edge of the veneer is firmly engaged. For a nominal 0.140-inch veneer, for example, this inlet opening spacing can be 0.100-inch, for example.

To assist in transporting the veneer through the curved channel 46, the mechanical means 14 also includes drive means for rotating the rollers 38 of the roller assembly 24 and drive means for rotating the rollers 44 of the roller assembly 26. The drive means for the rollers 38 includes a motor 52 (FIGS. 3 and 4) having a rotor connected to sprocket wheels 54 connected to the spindles of the rollers 38. The connection of the motor 52 to the wheels 54 is made in the illustrated preferred embodiment through suitable gearing 55 and chains 56. In a particular implementation, the motor 52 is a three-phase, one-half horsepower electric motor having a variable frequency drive used to allow the speed of the rollers 38 to be matched with the speed of the cutting device 2. Matching these speeds reduces or eliminates breakage which has been found to occur when the speeds are not matched. This is geared appropriately in a particular implementation (e.g., in an 8.5:1 ratio in one particular implementation) to obtain a desired throughput rate, such as approximately two hundred feet per minute (note that none of these specific values is limiting of the invention). The drive means for the rollers 44 includes a matching motor 58 connected to sprocket wheels 60 mounted on the rollers 44 and interconnected by chains 62 (gearing can be used here as well).

Although not shown in the drawings, the flattening apparatus preferably also includes safety screens covering the drive means and rollers.

To use the flattening apparatus 4, the guide means 6 is connected to the cutting device 2 and the support means 16 is positioned relative to the guide means 6 so that veneers exit the guide means 6 directly into the inlet 48 of the channel 46 defined between the roller assemblies 24, 26. The motors 52, 58 are energized so that the rollers 38, 44 rotate. A board is fed into the cutting device 2, and a veneer is cut from the board. Specifically referring to a slicer of the aforementioned type having an oblique knife across a table of the slicer, as the veneer moves below the knife in the table of the slicer 2, the leading edge of the veneer is received in the vertical slot of the guide means 6. As the following portion of the veneer is sliced from the board, the veneer travels through the slot defined by the guide means 6. As the leading edge of the veneer leaves the guide means 6, it enters the inlet 48 of the channel 46 and is pulled in through the rotational force of the rotating rollers 38, 44. As explained above, this preferably occurs before the veneer has been completely severed from the board by the cutting device 2. Once the entire veneer has been separated from the board, the rotating rollers 38, 44 transport the veneer through the curved channel 46 to apply a counter twisting force to the veneer so that the veneer which has been received directly from the cutting device is twisted through the predetermined sector through which the curved roller assemblies are disposed. As mentioned above, this sector is preferably less than about 90° and in a particular implementation is between about 5° from vertical at the inlet and about 80° from vertical at the outlet. The width of the channel 46 is preferably adjusted automatically in response to the thickness of the veneer or veneers in the channel 46 (it is contemplated that multiple veneers could be processed through the mechanical means 14 at the same time). This can be done by using the air cylinder 43 and its pressure regulator as explained above, or by other suitable means. It is also preferred that the speed of the rollers 38, 44 match the speed of the cutting device 2. The flattening apparatus 4 outputs the flattened veneer or veneers for further processing as known in the art (e.g., onto a conveyor for transport to a drying apparatus) but which further processing is not part of the present invention and will not be further described.

It is contemplated that the veneer could be feed from either direction.

Thus, the present invention is well adapted to carry out the objects and attain the ends and advantages mentioned above as well as those inherent therein while preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for flattening veneer sliced from a board, comprising:

mechanical flattening means comprising driven rollers for moving veneer past the rollers mounted on opposing frames for providing a curved channel of about 90° such that as the veneer exits the flattening means it will be moving in the same direction and parallel to the longitudinal axis of the board as the veneer is sliced and for twisting the veneer about its axis transverse through a sector of less than about 90 degrees, wherein the veneer is never twisted about its longitudinal or transverse axis by more than about 90 degrees during slicing and flattening for mechanically applying a flattening force to veneer directly from a cutting device that slices veneer from a board, wherein rollers on opposing frames along the channel are offset such that the veneer sequentially passes rollers on opposing frames as it traverses the curved channel; and support means for supporting said mechanical means adjacent the cutting device.

2. An apparatus as defined in claim 1, wherein said mechanical means twists the veneer.

3. An apparatus as defined in claim 2, wherein the veneer is twisted through a predetermined sector of less than about 90°.

4. An apparatus as defined in claim 1, wherein said mechanical means includes:

inlet means for receiving the veneer in a substantially vertical orientation; and outlet means, spaced from said inlet means, for outputting the veneer in a substantially horizontal orientation.

5. An apparatus as defined in claim 1, wherein said mechanical means includes:

a first roller assembly connected to said support means; and a second roller assembly connected to said support means adjacent said first roller assembly, said first and second roller assemblies including respective pluralities of rollers disposed so that a curved channel is defined between said rollers, wherein said mechanical means transports the veneer through said curved channel and said rollers apply the flattening force to the veneer as the veneer is transported therethrough.

6. An apparatus as defined in claim 5, wherein said mechanical means further includes:

first drive means for rotating the respective said rollers of said first roller assembly; and second drive means for rotating the respective said rollers of said second roller assembly.

7. An apparatus as defined in claim 5, wherein said curved channel has an elongated inlet opening disposed about 5° from vertical and an elongated outlet opening disposed about 80° from vertical.

8. An apparatus as defined in claim 5, wherein a majority, but less than all, of said rollers of said first roller assembly are offset from corresponding ones of said rollers of said second roller assembly.

9. An apparatus as defined in claim 5, wherein:

said first roller assembly is pivoted to said support means and said second roller assembly is fixed to said support means; and said mechanical means further includes means for moving said first roller assembly about the pivoted connection so that said first roller assembly is movable relative to said second roller assembly.

10. An apparatus as defined in claim 1, further comprising guide means, disposed adjacent the cutting device, for guiding the veneer directly from the cutting device into said mechanical means.

11. A method of flattening veneer sliced from a board, comprising receiving veneer twisted along its longitudinal and transverse axes directly from a veneer slicing device and mechanically applying a flattening force to the veneer directly from a cutting device that slices the veneer from a board as the veneer is moved through a curved channel of about 90° such that as the veneer exits the curved channel it will be moving in the same direction and parallel to the longitudinal axis of the board as the veneer is cut, wherein the veneer is twisted about its transverse axis by an amount of less than about 90 degrees as the veneer passes through the curved channel, wherein the veneer is never twisted about its longitudinal or transverse axis by more than about 90 degrees during slicing and flattening.

12. A method as defined in claim 11, wherein:

the cutting device is a slicer and the veneer is sliced by an obliquely disposed knife of the slicer;

the application of the flattening force is begun prior to a trailing edge of the veneer being severed from the board; and the flattening force is applied through a curved channel defined between two roller assemblies operated at a speed matched with a speed of the slicer.

13. A method of flattening veneer sliced from a board, comprising:

receiving veneer directly from a cutting device; and twisting the received veneer through a predetermined sector of less than about 90 degrees counter to a predetermined orientation of twist normally obtained by the veneer as the veneer is cut as the veneer is moved through a curved channel of about 90 such that as the veneer exits the curved channel it will be moving in the same direction and parallel to the longitudinal axis of the board as the veneer is cut wherein the veneer is never twisted about its longitudinal or transverse axis by more than about 90° degrees during slicing and flattening.

14. A method as defined in claim 13, wherein the predetermined sector is less than about 90°.

15. A method as defined in claim 14, wherein the predetermined sector starts about 5° from vertical and ends about 80° from vertical.

16. A method as defined in claim 13, further comprising guiding the veneer directly from the cutting device in a substantially vertical orientation so that the veneer is twisted through the sector from substantially vertical to substantially horizontal.

17. A method as defined in claim 13, wherein a leading end of the veneer is received prior to a trailing end of the veneer being fully severed from a board from which the veneer is cut by the cutting device.

18. A method as defined in claim 13, wherein the veneer is received at a speed matched with a speed of the cutting device.

19. A method as defined in claims 13, wherein the veneer is received in a channel defined by two roller assemblies automatically spaced in response to the thickness of the veneer.

20. A method as defined in claims 13, wherein the cutting device is a slicer and the veneer is sliced by an obliquely disposed knife of the slicer.

21. A method as defined in claim 19, wherein rollers along the two roller assemblies are spaced such that pressure is applied to the veneer sequentially by a roller assembly followed by a roller on the other roller assembly as veneer is moved through the curved channel.

* * * * *